United States Patent [19]

Morales

[11] 4,143,291

[45] Mar. 6, 1979

[54] DYNODE FOR A PHOTOMULTIPLIER TUBE

[75] Inventor: John J. Morales, Huntington, Conn.

[73] Assignee: S.R.C. Laboratories, Inc., Fairfield, Conn.

[21] Appl. No.: 761,911

[22] Filed: Jan. 24, 1977

Related U.S. Application Data

[63] Continuation-in-part of Ser. No. 679,339, Apr. 22, 1976, which is a continuation-in-part of Ser. No. 544,016, Jan. 24, 1975, Pat. No. 3,959,680.

[51] Int. Cl.[2] ..... H01J 43/10

[52] U.S. Cl. ..... 313/103 R; 313/105 R

[58] Field of Search ..... 313/95, 96, 103 R, 103 CM, 313/104, 105 R, 105 CM, 349, 363, 365, 373, 379, 377, 374, 376; 250/207; 328/243

[56] References Cited

U.S. PATENT DOCUMENTS

| | | | |
|---|---|---|---|
| 2,133,132 | 10/1938 | Clamann | 313/95 X |
| 2,160,798 | 5/1939 | Teal | 313/105 |
| 2,197,652 | 4/1940 | Statz et al. | 250/174 |
| 2,216,282 | 10/1940 | Schwartz et al. | 313/105 |
| 2,245,614 | 6/1941 | Shockley | 313/105 |
| 2,433,941 | 1/1948 | Weimer | 313/377 |
| 2,872,721 | 2/1959 | McGee | 313/105 CM |
| 2,942,133 | 6/1960 | McGee | 313/105 X |
| 3,060,343 | 10/1962 | Goff et al. | 313/377 X |
| 3,207,997 | 9/1965 | Eberhardt | 313/95 X |

FOREIGN PATENT DOCUMENTS

| | | | |
|---|---|---|---|
| 227470 | 1943 | Switzerland | 328/243 |

*Primary Examiner*—Robert Segal
*Attorney, Agent, or Firm*—Ernest M. Junkins

[57] ABSTRACT

A dynode has a plurality of circular elements that are planar, concentric and electrically interconnected for decreasing the variation in the number of secondary electrons emitted for each impinging primary electron when the primary electrons impinge from different angular directions.

14 Claims, 9 Drawing Figures

DYNODE FOR A PHOTOMULTIPLIER TUBE

The present invention is a continuation-in-part of my copending U.S. application Ser. No. 679,339, filed Apr. 22, 1976 which was a continuation-in-part based on a non-elected invention disclosed in my U.S. patent application Ser. No. 544,016, filed Jan. 24, 1975, now U.S. Pat. No. 3,959,680.

The said U.S. patent, when originally filed as an application, related to a photomultiplier tube, which in one tube envelope, was able to provide an independent electrical signal for the light being sensed by each of four different sensing areas of the tube. The application disclosed and claimed, a unique dynode structure for aiding in the separation of the signals and said dynode was held to be drawn to a non-elected invention. The first mentioned continuation-in-part application included said dynode plus additional matter relating to the use of a plurality of such dynodes as succeeding stages in a plural stage photomultiplier tube for decreasing the probability of secondary emitted electrons not impinging on the active area of the next succeeding dynode by tending to decrease spreading of the electrons from the axis of the tube. Further, said application disclosed that said dynode structure tended to reduce the variation in the number of secondary electrons that were emitted by each primary electron striking the dynode surface when the primary electrons struck from different angular directions.

In addition to the specific design of the dynode hereinbefore disclosed, applicant has found other and different configurations of dynodes which also tend to reduce the above-noted variation. However, these configurations are all basically related in that each consists of a plurality of ring-like or circular elements which are mounted to be concentric and planar and which are all electrically interconnected to be at the same electrical potential. Moreover, within such a basic dynode structure, applicant has found that, when each circular element has at least one surface that is linear in cross-section the angle of the surface with the axis of the tube does not tend to materially alter the reduction in variation of the number of emitted electrons. Hence, circular elements having planar surfaces that extend from being essentially parallel to the tube axis to being perpendicular to the tube axis may accordingly be utilized.

Other features and advantages will hereinafter appear:

In the drawing

Figure 1:
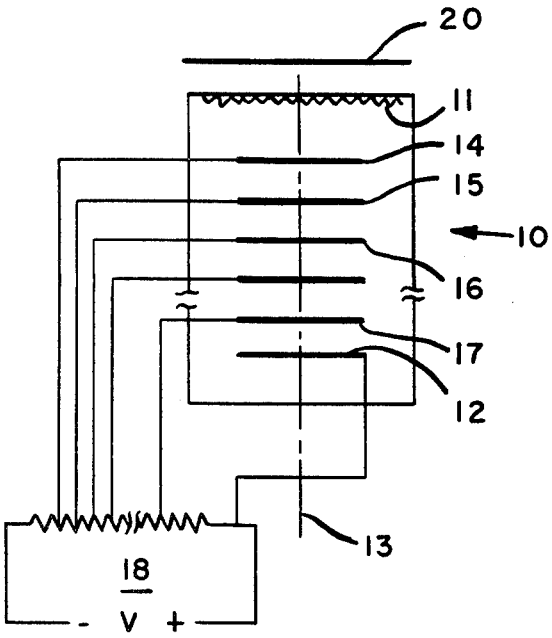
FIG. 1 is a schematic diagram of a photomultiplier tube having a plurality of successive secondary electron emitting stages or dynodes.

Referring to the drawing, a plural stage photomultiplier tube is generally indicated by the reference numeral 10 and includes a cathode 11 and an anode 12. The cathode and anode are axially aligned along an axis

13 of the tube and positioned therebetween are a plurality of secondary electron emitting stages or dynodes 14, 15, 16, etc. The dynodes and the anode are each connected to a source of electrical potential 18 in a manner which provides a potential difference between the successive dynodes and the anode. Light rays striking the cathode 11 cause the cathode to produce primary electrons which are attracted to the first dynode 14. Each primary electron striking the surface of the dynode 14 causes secondary electrons to be emitted which in turn, become primary electrons to be attracted to the next dynode 15 and upon impinging thereon, cause further secondary electrons to be emitted. Accordingly, each stage in the photomultiplier tube will receive primary electrons and emit secondary electrons upon the impingement thereof with the anode 12 collecting the secondary electrons emitted by the final dynode of the tube.

The number of electrons collected provide an electrical signal whose value is desirably directly related to the quantity of light received by the cathode 11. Thus, any primary electron which fails to impinge upon its adjacent dynode will cause a deviation in the signal and further any electron which impinges upon a dynode and fails to produce the same number of secondary electrons will also introduce an error in the relationship. As the number of secondary electrons emitted by the first dynode 14 are multiplied by the succeeding dynodes, reduction of variation in the number of secondary electrons produced by the dynode 14 for each primary electron will have a greater effect on the relationship than any one of the subsequent dynodes. Further, the effect of the variation on the relationship for each dynode reduces with the nearness of the dynode to the anode.

Figure 2:
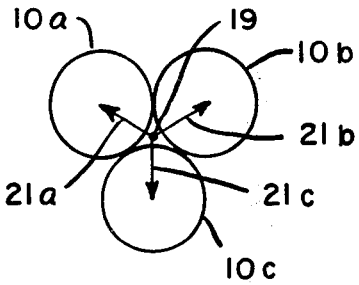
FIG. 2 is a diagram representation of the disposition of a plurality of photomultiplier tubes positioned to have each sense light rays from a pin-point source.

Shown in FIG. 2 is a representation of the relative positioning of three identical photomultiplier tubes, 10*a*, 10*b* and 10*c* with respect to a pin-point light source 19. If the tubes are positioned as shown and the light source 19 for example is located on a plane 20 slightly above the cathodes and equi-distant from each tube, light rays 21*a*, 21*b* and 21*c* represented by arrows, may be assumed to travel in the directions indicated from the source 19 towards the axis of each tube. Each tube will sense the light rays impinging on its cathode and as each tube will receive the same quantity of light and as the tubes are assumed to be identical, then each tube should provide the same electrical signal at its anode. The light rays that strike the cathode produce thereat cathodic electrons and the cathodic electrons are electron-optically directed to move towards the center or axis of the first dynode. Such electron movement has components parallel with the tube axis and also transverse thereto with the latter generally being related to the off-axis distance of the point of light reception. Thus, the transverse angularity of a light ray arriving at the cathode influences the general transverse angular direction of movement of the cathodic electrons and hence the general transverse angular direction of the impact of the cathodic electrons on the first dynode's surfaces. While impact of said cathodic electrons on the first dynode 14 will cause secondary electrons to be emitted, it has been found that the number of electrons emitted tends to vary with the angle of impact on the dynode's surface and hence the signal, assuming all other factors to be equal, produced by the three heretofore known tubes 10*a*, 10*b* and 10*c*, will be undesirably different.

Figure 3:
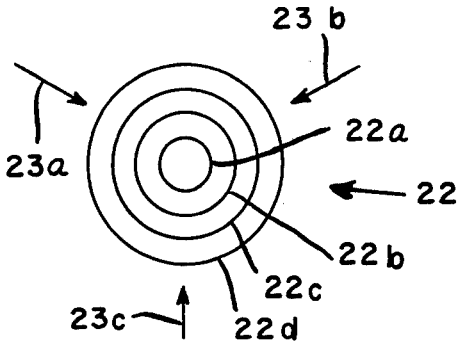
FIG. 3 is a diagrammatic plan representation showing some possible angular directions that primary electrons may have when moving towards a dynode.

In accordance with the present invention, a dynode is constructed of a plurality of different diameter circular elements so that an electron will strike a dynode surface with essentially the same angle of impact for all possible transverse angular directions in a plane perpendicular to the axis at each constant radius in said plane. In FIG. 3, a dynode 22 is represented having a plurality of concentric circular elements 22*a*, 22*b*, 22*c* and 22*d*. Also three possible transverse directions of movement of a primary electron from a plane perpendicular to the axis of the dynode, cathodic or otherwise, are shown by arrows 23*a*, 23*b* and 23*c*. An electron having a transverse angular direction indicated by the arrow 23*a* will impinge upon a surface of the elements at the same angle that an electron moving in the transverse angular direction of arrow 23*b* will strike a surface as will an electron moving in the direction of arrow 23*c*. Thus by the use of the present invention, variations in the number of secondary emitted electrons attributable to different transverse angular directions of impinging primary electrons are minimized by minimizing the variations in the angle of impact.

Figure 4:
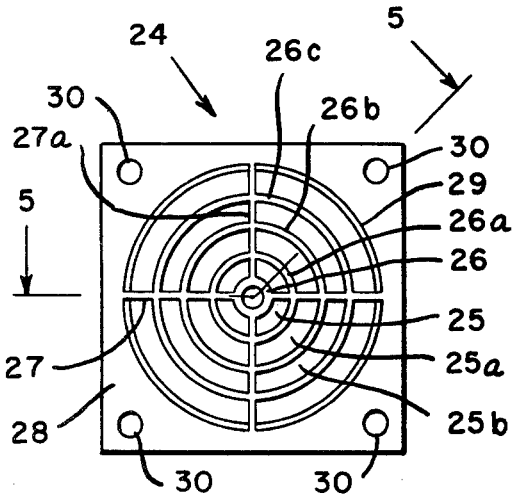
FIG. 4 is a bottom view of one embodiment of a dynode of the present invention, somewhat enlarged.
Figure 5:
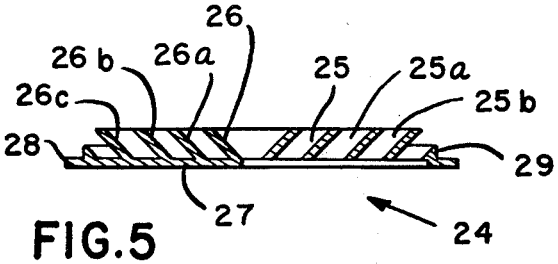
FIG. 5 is a section taken on the line 5—5 of FIG. 4.

Shown in FIG. 4 is a bottom view of one embodiment of a dynode 24 that incorporates the present invention with FIG. 5 being a section thereof taken on the line 5—5. The dynode 24 is formed from a relatively thick solid piece of material, such as metal with one example being beryllium copper, by machining slots 25, 25*a*, 25*b* shaped as frustums of cones, in the upper surface of the piece. The machined slots do not extend completely through the piece 24 so that there is left after the machining operation, a flat portion on the bottom of the piece with concentric circular elements 26, 26*a*, 26*b* and 26*c* being integral with the bottom and projecting thereabove. The bottom portion of the piece, which may have a thickness of about 10 thousandths of an inch, is then removed to have the slots 25 pass through the piece. The bottom is completely removed except for narrow straight bars 27 and 27*a* that extend from one of the edge portions 28 of the piece to another edge portion. Thus the slots 25 extend completely through except where interrupted by bars 27. As all parts of the dynode 24 are initially machined from the same piece so that the bars 27 are thus integral with the edge portions 28 of the piece and the circular elements 26, there is thus provided a unitary structure with the bars supporting the elements 26. The bottom portion may be removed where indicated in any desired manner as electro-erosion, chemical etching, etc.

The dynode as so constructed, has essentially equally spaced circular elements 26 whose sides are linear in cross-section and inclined with respect to the dynode axis 13 but yet in which the elements are concentric therewith and also planar by all elements being at the same level. As the dynode 24 is unitary and formed of conducting material, an electrical connection to the edge portion 28 from the power supply 18 will cause all parts of the dynode to be at the same electrical potential. Preferably, as shown in this embodiment, the bars 27 and 27*a* intersect in a small circle which permits an opening 27*c* to be formed along the axis of the tube though such an opening 27*c* in other embodiments may be eliminated, if desired.

The piece 24 is also desirably machined to have the edge portions 28 be of essentially the same thickness as the bars and also include an upstanding circular flange 29 which circumscribes the elements 26. The edge portions 28 may have apertures 30 formed therein for supporting the dynode in the tube or if desired, a separate frame may be used.

Figure 6:
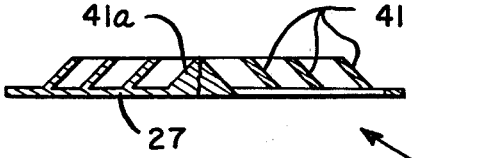
FIGS. 6, 7, 8 and 9 are views, similar to FIG. 5 of different embodiments of dynodes incorporating the present invention.

In the dynode embodiment shown in FIG. 6 and indicated by the reference numeral 40, the dynode is again formed with planar and concentric circular elements 41 which are supported by bars 27. However, the elements 41 diverge with respect to the axis in the direction of the supporting bars 27 rather than converge towards the axis as in the previous embodiment.

Figure 7:
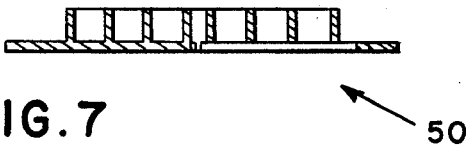
Figure 8:
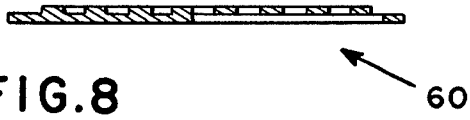

In the embodiment shown in FIG. 7 and indicated by the reference numeral 50, each of the circular elements is formed to have its linear cross-sectional surfaces parallel with the axis while in the FIG. 8 embodiment, indicated by the reference numeral 60, the circular elements are formed to have their linear cross-sectional surfaces perpendicular to the axis of the dynode.

Figure 9:
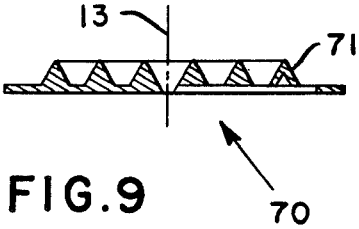

In the FIG. 9 dynode embodiment, indicated by the reference numeral 70, each of the circular elements has a cross-section that is conical to provide linear cross-sectional surfaces that both diverge and converge towards the axis 13 of the dynode. While most of the elements shown in this embodiment have cross-sections that are solid, it is also considered to be within the scope of the present invention to remove some of such material such as shown in the cross-section of element 71 with removal being if desired by electro-erosion. Similarly, the center element 41*a* in the FIG. 6 embodiment, may also have portions thereof removed, if desired.

After forming the piece to the desired dynode shape, a covering of electron emissive material is applied generally to the complete shape, but in any event, at least to those surfaces of the circular elements on which electrons can be expected to impinge which is generally the linear cross-sectional surfaces and thus each element will have at least one surface which is covered by electron emissive material.

It has been found adventangeous in decreasing the variation to have at least the first dynode 14 of the tube 10 be formed in accordance with the present invention. The other dynodes may be of the same configuration as the first or they may be different, as desired. As disclosed in my above-noted application, dynodes of the converging and diverging type (FIGS. 5 and 6 embodiments respectively), may alternate.

It should be noted that while the circular elements reduce variations in impact angle for transverse directions, that the use of a plurality thereof minimizes the variation of the impact angle for directions aligned with the axis of the dynode. The plurality of elements do not tend to introduce substantially further or different transverse movement to the electrons than that which they initially possessed as would occur if only one circular element were present in the dynode.

While the dynodes as shown, do not have grid elements, such may be added in any convenient manner.

It will accordingly be understood that there has been disclosed a unitary dynode structure formed of a plurality of different diameter circular elements. Narrow bars extend along similar edges of the elements to support them coaxially along the dynode axis and in the same plane perpendicular to said axis. The bars are integral with the elements and the edge portions of the dynode so that when an electrical potential is applied to the dynode, all parts will have the same potential.

Variations and modifications may be made within the scope of the claims and portions of the improvements may be used without others.

I claim:

1. A dynode for use as an electron multiplier stage comprising a plurality of different diameter circular elements with there being at least three circular elements, means mounting the elements to be concentric about an axis with their upper and lower edges being in first and second planes and including means electrically interconnecting the plurality of elements to have all the elements be at the same electrical potential, means forming an electron emissive surface on at least one surface of each of the elements and in which each surface is positioned to extend at an angle with the axis with the extent of the angle including being perpendicular to the axis and being parallel with the axis.

2. The invention as defined in claim 1 in which the mounting means includes at least one thin metallic strip, in which the strip is connected to each element and in which the strip constitutes the electrical interconnecting means.

3. The invention as defined in claim 2 in which the dynode has edge portions and in which the edge portions, the strip and the circular elements are formed from a unitary piece of electrically conducting material.

4. The invention as defined in claim 1 in which each element has one surface that is linear in diametrical cross-section.

5. The invention as defined in claim 4 in which the one linear cross-sectional surface of each element extends perpendicularly to the axis of the dynode.

6. The invention as defined in claim 5 in which the one linear cross-sectional surface of each element extends parallel to the axis of the dynode.

7. The invention as defined in claim 4 in which the one linear cross-sectional surface of each element extends to converge towards the axis in the direction of the mounting means.

8. The invention as defined in claim 4 in which the one linear cross-sectional surface of each element extends to diverge from the axis in the direction of the mounting means.

9. The invention as defined in claim 1 in which the mounting means includes a pair of thin metallic strips that are connected to each element, in which the strips extend in a plane perpendicular to the axis and in which all the elements are located to project in the same direction from the strips.

10. A dynode for use as an electron multiplier stage comprising at least three different size frustums of cones formed of thin metal, means mounting the frustums to be concentric about an axis with their upper and lower edges being in first and second planes and including means electrically interconnecting each frustums to have all the frustums be at the same electrical potential and means forming an electron emissive surface on the frustums.

11. The invention as defined in claim 10 in which the frustums are dimensioned to have an essentially constant transverse spacing between adjacent frustums and in which the frustums are each formed to have essentially the same height transverse to the concentric axis.

12. The invention as defined in claim 10 in which each frustum is constructed and arranged to extend at essentially the same angle to the concentric axis.

13. The invention as defined in claim 10 in which the mounting means includes a pair of thin intersecting metallic strips with their intersection essentially coinciding with the concentric axis.

14. The invention as defined in claim 13 in which the thin strips are connected to the corresponding one end of each of the frustums and constitute the means electrically interconnecting the frustums.

* * * * *